US007210437B2

(12) United States Patent
Geyer

(10) Patent No.: US 7,210,437 B2
(45) Date of Patent: May 1, 2007

(54) PERIODICALLY ACTUABLE TAPPET FOR A VALVE TRAIN OR A PUMP DRIVE

(75) Inventor: Norbert Geyer, Hochstadt (DE)

(73) Assignee: INA-Schaeffler KG, Herzogenaurach (DE)

( * ) Notice: Subject to any disclaimer, the term of this patent is extended or adjusted under 35 U.S.C. 154(b) by 40 days.

(21) Appl. No.: 11/183,022

(22) Filed: Jul. 15, 2005

(65) Prior Publication Data

US 2006/0016406 A1 Jan. 26, 2006

(30) Foreign Application Priority Data

Jul. 24, 2004 (DE) ..... 10 2004 036 106

(51) Int. Cl.
*F01L 1/14* (2006.01)

(52) U.S. Cl. ..... 123/90.5; 123/90.48; 123/90.51; 74/569

(58) Field of Classification Search ..... 123/90.5
See application file for complete search history.

(56) References Cited

U.S. PATENT DOCUMENTS

| | | | | |
|---|---|---|---|---|
| 5,975,038 | A * | 11/1999 | Fischer et al. | 123/90.55 |
| 7,121,244 | B2 * | 10/2006 | Roe et al. | 123/90.5 |
| 2006/0107917 | A1 * | 5/2006 | Backert et al. | 123/90.48 |
| 2006/0112915 | A1 * | 6/2006 | Kreil et al. | 123/90.5 |

FOREIGN PATENT DOCUMENTS

| | | |
|---|---|---|
| DE | 195 01 061 | 7/1996 |
| DE | 196 00 852 | 7/1997 |
| DE | 199 50 989 | 6/2000 |
| DE | 199 15 531 | 10/2000 |
| DE | 101 10 914 | 9/2002 |

* cited by examiner

*Primary Examiner*—Thomas Denion
*Assistant Examiner*—Kyle M. Riddle
(74) *Attorney, Agent, or Firm*—Lucas & Mercanti, LLP

(57) ABSTRACT

The invention proposes a periodically actuable tappet (1) for a valve train, said tappet (1) comprising a hollow cylindrical skirt (2) that can be arranged through an outer peripheral surface (3) in a guide bore (4) of a surrounding structure (5), said skirt (2) comprising a window-type aperture (6) in which a separate anti-rotation device (8) is arranged through a radially inner portion (7), a radially outer portion (9) of the anti-rotation device (8) extending beyond the skirt (2) for guidance in a longitudinal groove (10) that intersects the guide bore (4), wherein the anti-rotation device (8), as viewed in cross-section, is substantially mushroom-shaped, the inner portion (7) has a rectangular cross-section corresponding to a geometry of the aperture (6) of the skirt (2), into which cross-section, the outer portion (9) merges in the manner of a roof through a fractional cylindrical outer peripheral surface (11), inner legs (12) of the outer portion (9) extend beyond the aperture (6) in peripheral direction and bear against the outer peripheral surface (3) of the skirt (2). Through the measures of the invention, a radially inward directed excursion of the anti-rotation device (8) during operation of the tappet (1) is prevented.

7 Claims, 1 Drawing Sheet

PERIODICALLY ACTUABLE TAPPET FOR A VALVE TRAIN OR A PUMP DRIVE

FIELD OF THE INVENTION

The invention concerns a periodically actuable tappet for a valve train or a pump drive, said tappet comprising a hollow cylindrical skirt that can be arranged through an outer peripheral surface in a guide bore of a surrounding structure, said skirt comprising a window-type aperture in which a separate anti-rotation device is arranged through a radially inner portion, a radially outer portion of the anti-rotation device extending beyond the skirt for guidance in a longitudinal groove that intersects the guide bore.

BACKGROUND OF THE INVENTION

A tappet of the pre-cited type with a separate anti-rotation device is known from DE 195 01 061 A1. This anti-rotation device comprises a needle roller that is retained radially inwards through a sheet metal element arranged on the inner peripheral surface of the skirt. The sheet metal element used as a "counter-holder" for the anti-rotation device unnecessarily increases the complexity and costs of the component. In addition, during operation of the tappet, there exists the danger that, with a widening of the sheet metal element, the anti-rotation device can migrate gradually in radially inward direction. In the worst case, a proper prevention of rotation of the tappet would not be guaranteed.

OBJECTS OF THE INVENTION

It is an object of the invention to provide a tappet of the pre-cited type in which the aforesaid drawbacks are eliminated with simple measures.

This and other objects and advantages of the invention will become obvious from the following detailed description.

SUMMARY OF THE INVENTION

The invention achieves the above objects by the fact that, as viewed in cross-section, the anti-rotation device is substantially mushroom-shaped, the inner portion has a rectangular cross-section corresponding to a geometry of the aperture of the skirt, into which cross-section, the outer portion merges in the manner of a roof through a fractional cylindrical outer peripheral surface, inner legs of the outer portion extend beyond the aperture in peripheral direction and bear against the outer peripheral surface of the skirt.

Through the generally mushroom-shaped configuration of the anti-rotation device, its radially inward excursion is effectively prevented. In radially outward direction, there is a design-related limitation due to the longitudinal groove of the surrounding structure, for example a cylinder head, so that, if necessary, it is also possible and intended to arrange the anti-rotation device loosely in the aperture of the skirt.

In place of the proposed rectangular cross-section of the aperture, other geometries like triangular or polygonal or rounded shapes are also conceivable. The scope of protection of the invention extends likewise to geometries of the outer peripheral surface of the outer portion of the anti-rotation device deviating from the proposed cylindrical shape. The important thing in this connection is only that the shape of the longitudinal groove of the surrounding structure must be complementary to the shape of the outer peripheral surface of the outer portion.

The invention further proposes simple measures for fixing the inner portion of the anti-rotation device in the aperture. Fixing may be achieved by pressing-in, gluing welding or soldering. In the case of pressing-in, fixing can be effected through end faces and/or lateral surfaces of the inner portion.

According to an alternative proposition of the invention, the inner portion may protrude slightly beyond the skirt of the tappet in radially inward direction and its lateral surfaces can be swaged onto an inner peripheral surface of the skirt of the tappet. If necessary, regions of a front end of the inner portion can also be swaged. This is a very simple manner of fixing and is similar to riveting. A particular advantage of this method is that the anti-rotation device is fixed on the skirt in a quasi stress-free positive engagement.

Fabrication is greatly simplified if the anti-rotation device is "chopped" or cut off, for example, from profiled, drawn bar stock for industrial scale production. It is, however, also conceivable to produce the cross-section of the anti-rotation device by a machining method such as milling or the like.

According to a further feature of the invention, the tappet is configured as a cup tappet. But other rotationally symmetric cam followers such as push rod-activating roller tappets or the like are also conceivable. Besides this, the tappet of the invention comprising the anti-rotation device can also be used as a pump tappet, for instance in injection pumps for fuel and the like or quite generally in feed pumps and compressors.

The invention will now be described more closely with reference to the appended drawing.

DETAILED DESCRIPTION OF THE DRAWING

Figure 1:
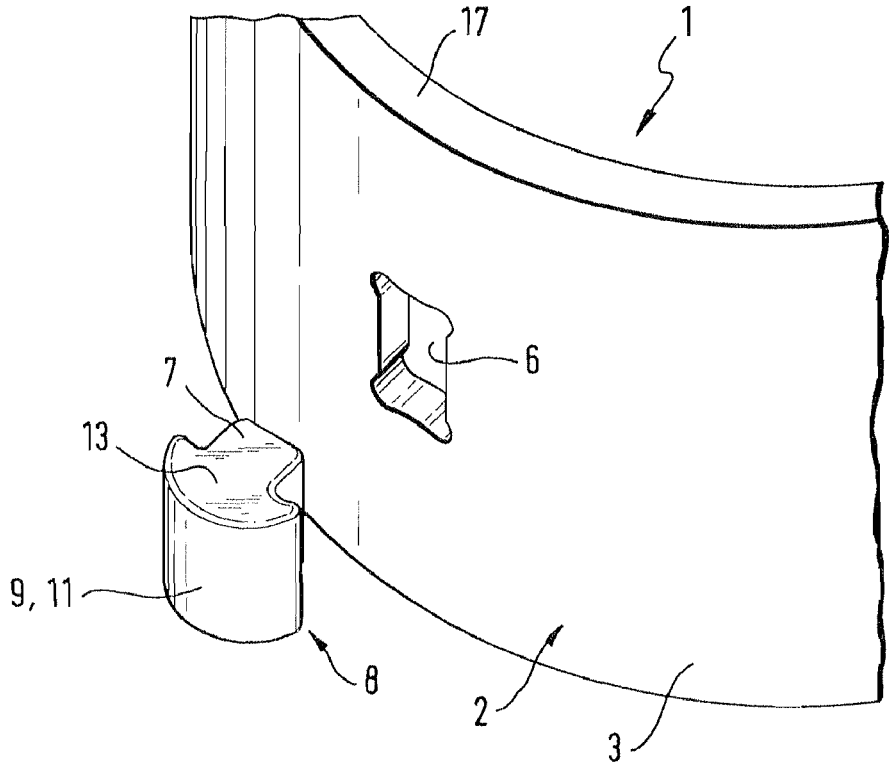
FIG. 1 is a partial perspective view of a skirt of a tappet comprising an anti-rotation device of the invention.

FIG. 1 shows a partial view of a skirt 2 of a tappet 1, for example, a cup tappet for a valve train of an internal combustion engine. As shown in part, the tappet 1 comprises a hollow cylindrical skirt 2 that is arranged through its outer peripheral surface 3 for oscillating in a guide bore 4 (see FIG. 2) of a surrounding structure 5 (e.g. a cylinder head). At one front end 17 (see FIG. 1), the tappet 1 is closed by a bottom (not shown) that acts as a running contact surface for at least one cam. The bottom may also have a cylindrical configuration as viewed in an excursion direction of the cam.

As can be seen further in the figures, the skirt 2 comprises an aperture 6. An anti-rotation device 8 is arranged in this aperture 6. As viewed in cross-section, this anti-rotation device 8 has a mushroom-shaped geometry and comprises an inner portion 7 and an outer portion 9. The inner portion 7, that is advantageously made in one piece with the outer portion 9, has a substantially rectangular cross-section. The outer portion 9, in contrast, has in radially outward direction, an outer peripheral surface 11 in the form of a fractional cylinder and is "seated" like a roof on the inner portion 7.

The outer portion 9 extends on the outer peripheral surface 3 of the skirt 2 through inner legs 12 that are situated opposite the outer peripheral surface 11 of the outer portion 9. An excellent positional fixing of the anti-rotation device 8 is thus realized in radially inward direction through this configuration. In other words, a radially inward migration of the anti-rotation device 8 is effectively prevented due to the fact that the inner legs 12 are supported on the outer peripheral surface 3 of the skirt 2.

Figure 2:
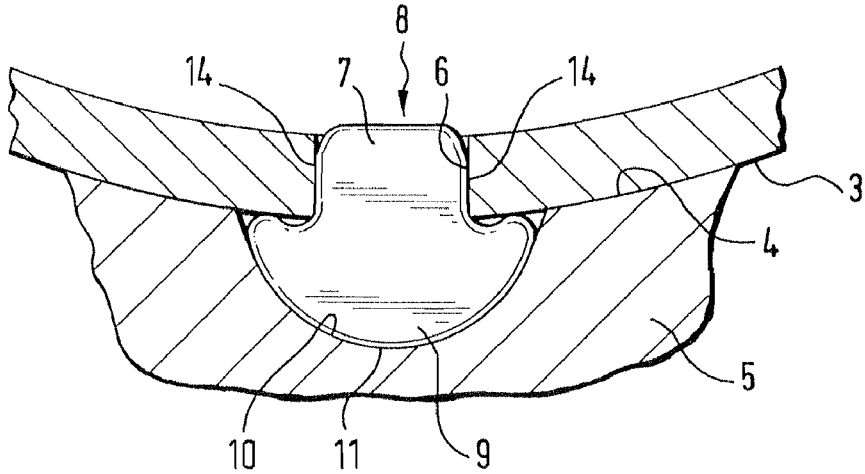
FIG. 2 shows a cross-section through the anti-rotation device of the invention in an installed state.

In the embodiment of the invention shown in FIG. 2, the inner portion 7 of the anti-rotation device 8 can be fixed in the aperture 6 by pressing-in. This press or interference fit can be achieved through end faces 13 or through lateral surfaces 14 of the inner portion 7.

A person skilled in the art will further see from FIG. 2 that the fractional cylindrical outer peripheral surface 11 of the outer portion 9 of the anti-rotation device 8 is complementary in shape to a longitudinal groove 10 of the surrounding structure 5.

Figure 3:
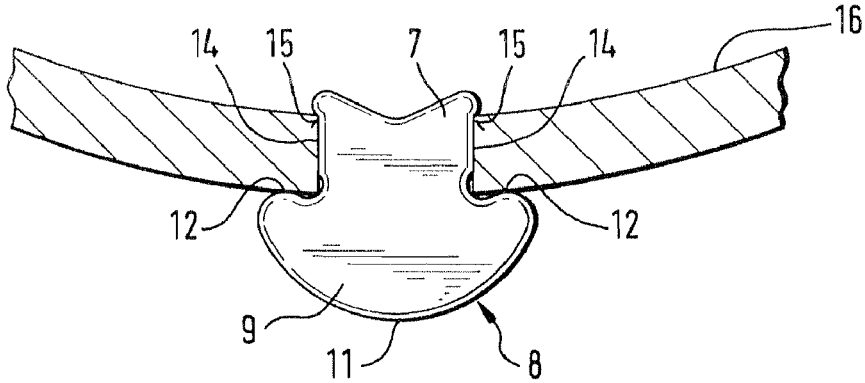
FIG. 3 shows a further cross-section through the anti-rotation device of the invention in an installed state.

FIG. 3 discloses a rivet-like fixing of the anti-rotation device 8 in the skirt 2. In this embodiment, the lateral surfaces 14 of the inner portion 7 of the anti-rotation device 8 have a length such that they protrude radially inwards slightly beyond the skirt 2. These protruding regions are simply swaged onto adjoining portions 15 of an inner peripheral surface 16 of the skirt 2. The advantage of this type of fixing is that no stresses are introduced into the region of the skirt 2.

Alternatively, however, it is also conceivable and intended to merely insert the anti-rotation device 8 "loosely" into the aperture 6. This is a particularly favorable measure with regard to the overall costs of the tappet 1. A fixing in radially outward direction is achieved in this case through the longitudinal groove 10 of the surrounding structure 5, whereas a fixing in radially inward direction is created through the support of the inner legs 12 on the outer peripheral surface 3 of the skirt 2.

The invention claimed is:

1. A periodically actuable tappet for a valve train or a pump drive, said tappet comprising a hollow cylindrical skirt that can be arranged through an outer peripheral surface in a guide bore of a surrounding structure, said skirt comprising a window-type aperture in which a separate anti-rotation device is arranged through a radially inner portion, a radially outer portion of the anti-rotation device extending beyond the skirt for guidance in a longitudinal groove that intersects the guide bore, wherein the anti-rotation device, as viewed in cross-section, is substantially mushroom-shaped, the inner portion has a rectangular cross-section corresponding to a geometry of the aperture of the skirt, into which cross-section, the outer portion merges in the manner of a roof through a fractional cylindrical outer peripheral surface, inner legs of the outer portion extend beyond the aperture in peripheral direction, are arched and bear downward against the outer peripheral surface of the skirt.

2. A tappet of claim 1, wherein the inner portion of the anti-rotation device is retained in the aperture by fixing by one of pressing-in, gluing, welding or soldering.

3. A tappet of claim 1, wherein the inner portion of the anti-rotation device is pressed into the aperture, a firm retention of the inner portion in the aperture being realized through at least one of end faces or lateral surfaces of the inner portion.

4. A tappet of claim 1, wherein the inner portion of the anti-rotation device is arranged loosely in the aperture.

5. A tappet of claim 1, wherein lateral surfaces of the inner portion of the anti-rotation device protrude radially inwards beyond the skirt and are swaged onto adjoining portions of an inner peripheral surface of the skirt.

6. A tappet of claim 1, wherein the anti-rotation device is made of profiled, drawn bar stock.

7. A tappet of claim 1, wherein the tappet is configured as a cup tappet for a valve train, one front end of the tappet is defined by a cylindrically arched bottom, and the tappet is designed for being selectively switched.

* * * * *